US006422163B2

(12) United States Patent
Kim

(10) Patent No.: US 6,422,163 B2
(45) Date of Patent: Jul. 23, 2002

(54) EMBROIDERY MACHINE AND METHOD FOR TRANSFERRING AN EMBROIDERY FRAME BACKWARD IN CASE OF THREAD BREAKAGE

(75) Inventor: Do Wan Kim, Inchon (KR)

(73) Assignee: Hankuk Special Precision Co., Ltd., Inchon (KR)

( * ) Notice: Subject to any disclaimer, the term of this patent is extended or adjusted under 35 U.S.C. 154(b) by 0 days.

(21) Appl. No.: 09/788,138

(22) Filed: Feb. 16, 2001

(30) Foreign Application Priority Data

Feb. 18, 2000 (KR) ..... 00-7898
Feb. 15, 2001 (KR) ..... 01-7556

(51) Int. Cl.[7] ..... D05B 21/00; D05B 69/18; D05C 9/06

(52) U.S. Cl. ..... 112/102.5; 112/278; 112/317

(58) Field of Search ..... 112/102.5, 470.06, 112/273, 278, 155, 300, 316, 317, 475.19; 700/138

(56) References Cited

U.S. PATENT DOCUMENTS 5,029,539 A * 7/1991 Yokoe et al. ..... 112/102.5
5,359,949 A 11/1994 Asano
6,123,037 A 9/2000 Shimizu

* cited by examiner

*Primary Examiner*—Peter Nerbun
(74) *Attorney, Agent, or Firm*—Akin, Gump, Strauss, Hauer & Feld, L.L.P.

(57) ABSTRACT

A method for transferring an embroidery frame backward in case of thread breakage, includes the steps of: a) detecting the thread breakage to generate a thread breakage signal if the thread breakage occurs at a needle contained in needle holders; b) generating the control signal to control an embroidery-frame driver in response to the thread breakage signal; and c) transferring the embroidery frame backward in response to the control signal.

27 Claims, 3 Drawing Sheets

EMBROIDERY MACHINE AND METHOD FOR TRANSFERRING AN EMBROIDERY FRAME BACKWARD IN CASE OF THREAD BREAKAGE

FIELD OF THE INVENTION

The present invention relates to an embroidery machine. More particularly, the present invention relates to an embroidery machine and method for transferring an embroidery frame contained in the embroidery machine backward when a thread is broken at an embroidery operation.

DESCRIPTION OF THE PRIOR ART

Generally, an embroidery machine embroiders an embroidery design on a fabric fixed on an embroidery frame during a needle holder contained in a sewing device moves up and down, and simultaneously, the embroidery frame moves to X-axis and Y-axis directions. Because the embroidery machine embroiders the embroidery design on the fabric while the embroidery frame moves to the X-axis and Y-axis directions, an accurate movement and a low vibration of the embroidery frame are closely involved with the quality of embroidery.

Conventionally, the embroidery machine includes an alternating current (AC) servomotor or an induction motor for moving the needle holder up and down. Further, the embroidery machine includes a stepping motor for moving the embroidery frame to the X-axis and Y-axis directions. Twelve to twenty-five sewing machines are serially connected in the form of one shaft so as to improve the productivity of the embroidery machine. Because the embroidery machine embroiders the embroidery design on the fabric with threads of different colors, each sewing device has six to twelve needle holders and needles contained in each needle holder are threaded with the threads of the different colors.

Recently, a convenient input, copy, save, and edition of an embroidery design data is needed in the embroidery machine. Also a user prefers an automatic embroidery machine. The automatic embroidery machine has an automatic thread changing function according to the embroidery design. After the embroidery operation has been completed, the automatic embroidery machine has a function capable of cutting a thread. When the thread is broken at the embroidery operation, the automatic embroidery machine has a function capable of stopping the automatic embroidery machine and displaying an alarm indication. When the automatic embroidery machine is stopped due to an abnormal power-off, the automatic embroidery machine has a function capable of recovering a power supply. Furthermore, a manufacturer or a merchandiser wants to use the embroidery machine including a computer or a microprocessor for implementing the embroidery machine having multiple functions.

Referring to FIG. 1, there is shown a block diagram illustrating a conventional embroidery machine. As shown, the conventional embroidery machine includes a function selection panel 10, an embroidery frame driver 20, a thread breakage detector 30, and a control unit 40. The function selection panel 10 has function selection keys for selecting a plurality of functions. The embroidery-frame driver 20 drives the embroidery frame in response to a control signal outputted from the control unit 40. The thread breakage detector 30 detects a broken thread. The control unit 40 controls the embroidery machine with a memory storing a program necessary to control the embroidery machine. If the thread breakage detector 30 detects the broken thread, the control unit 40 stops the embroidery operation. In addition, the control unit 40 is coupled to a setting data storage 50 and an embroidery design storage 60. The setting data storage 50 and the embroidery design storage 60 can be located in the inside or outside of the control unit 40. The setting data storage 50 stores a plurality of setting data needed for the embroidery operation, wherein the setting data includes an embroidery operation speed, selected needle holder-related information, etc. The embroidery design storage 60 stores embroidery design information. The control unit 40 can be implemented as a microprocessor. When the user selects a desired embroidery design from embroidery designs stored in the embroidery design storage 60, the control unit 40 controls the embroidery-frame driver 20.

When the thread is broken at the embroidery operation, the thread breakage detector 30 detects the broken thread and transmits a detection signal to the control unit 40. The control unit 40 can include a display, a lamp or a buzzer not shown in FIG. 1. When the thread is broken, the control unit 40 alarms the user through the display unit, the lamp or the buzzer. At this time, the control unit 40 controls the embroidery-frame driver 20 to stop the operation of the embroidery frame. Further, the user recognizes the broken thread through the display, the lamp or the buzzer. Then, the user finds out a needle of the broken thread and re-threads the needle of the broken thread.

At a state that the embroidery frame contained in the conventional embroidery machine is moved forward, the user should re-thread the needle of the broken thread. When the user re-threads the needle of the broken thread, the embroidery frame moved forward can be obstruction. Accordingly, the user employs a footstool to reach the needle of the broken thread. However, in case that the length of the embroidery machine is more than 750 mm, the user cannot easily re-thread the needle of the broken thread.

SUMMARY OF THE INVENTION

It is, therefore, an object of the present invention to provide an embroidery machine and method capable of transferring an embroidery frame backward so that a user can easily re-thread a needle of a broken thread in case of thread breakage.

It is, therefore, another object of the present invention to provide an embroidery machine and method capable of transferring an embroidery frame backward when a thread, especially, an upper-positioned thread is broken.

It is, therefore, further another object of the present invention to provide an embroidery machine and method capable of selectively setting an embroidery-frame transfer distance.

It is, therefore, still further another object of the present invention to provide an embroidery machine including an embroidery frame, which can be transferred backward or forward in response to a user request.

In accordance with a first aspect of the present invention, there is provided an embroidery machine for transferring an embroidery frame backward in case of thread breakage, the embroidery machine including the embroidery frame and needle holders holding needles, comprising: detection means for detecting the thread breakage to generate a thread breakage signal if the thread breakage occurs at a needle contained in the needle holders; transfer means for transferring the embroidery frame backward in response to a control signal; and control means, coupled to said detection means and said transfer means, for generating the control signal to control said transfer means in response to the thread breakage signal.

In accordance with a second aspect of the present invention, there is provided an embroidery machine for transferring an embroidery frame backward in case of thread breakage, the embroidery machine including the embroidery frame and needle holders holding needles, comprising: generation means for generating an embroidery-frame transfer request signal in response to a user request if the thread breakage occurs at a needle contained in the needle holders; transfer means for transferring the embroidery frame backward in response to a control signal; and control means, coupled to said transfer means and said generation means, for generating the control signal to control said transfer means in response to the embroidery-frame transfer request signal.

In accordance with a third aspect of the present invention, there is provided a method for transferring an embroidery frame backward in case of thread breakage, comprising the steps of: a) detecting the thread breakage to generate a thread breakage signal if the thread breakage occurs at a needle contained in needle holders; b) generating the control signal to control an embroidery-frame driver in response to the thread breakage signal; and c) transferring the embroidery frame backward in response to the control signal.

In accordance with a fourth aspect of the present invention, there is provided a method for transferring an embroidery frame backward in case of thread breakage, comprising the steps of: a) generating an embroidery-frame transfer request signal in response to a user request if the thread breakage occurs at a needle contained in needle holders; b) generating a control signal to control an embroidery-frame driver in response to the embroidery-frame transfer request signal; and c) transferring the embroidery frame backward in response to the control signal.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE INVENTION

Figure 1:
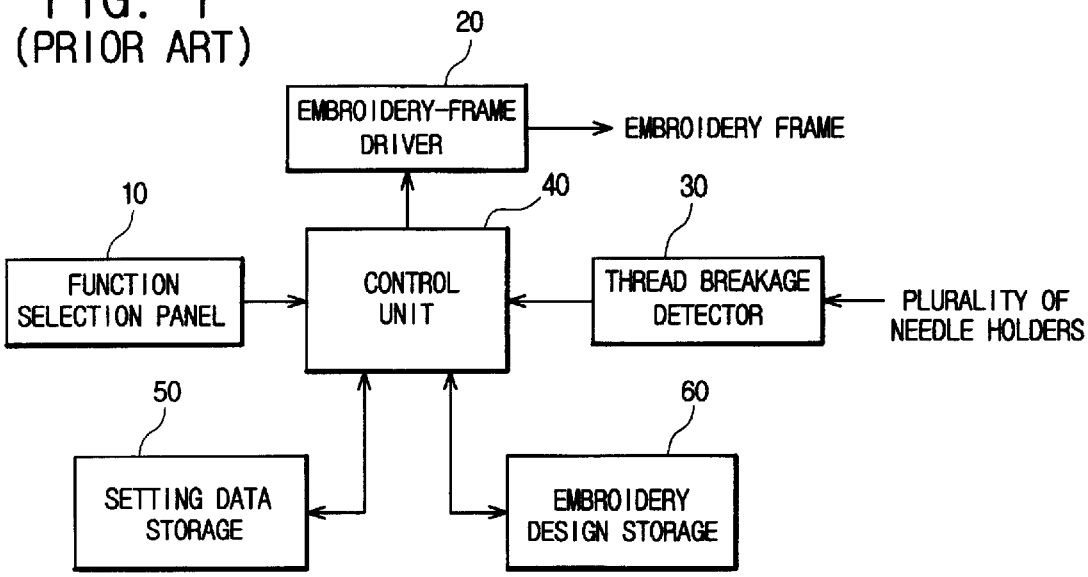
FIG. 1 (PRIOR ART)
FIG. 1 is a block diagram illustrating a conventional embroidery machine.
Figure 2:
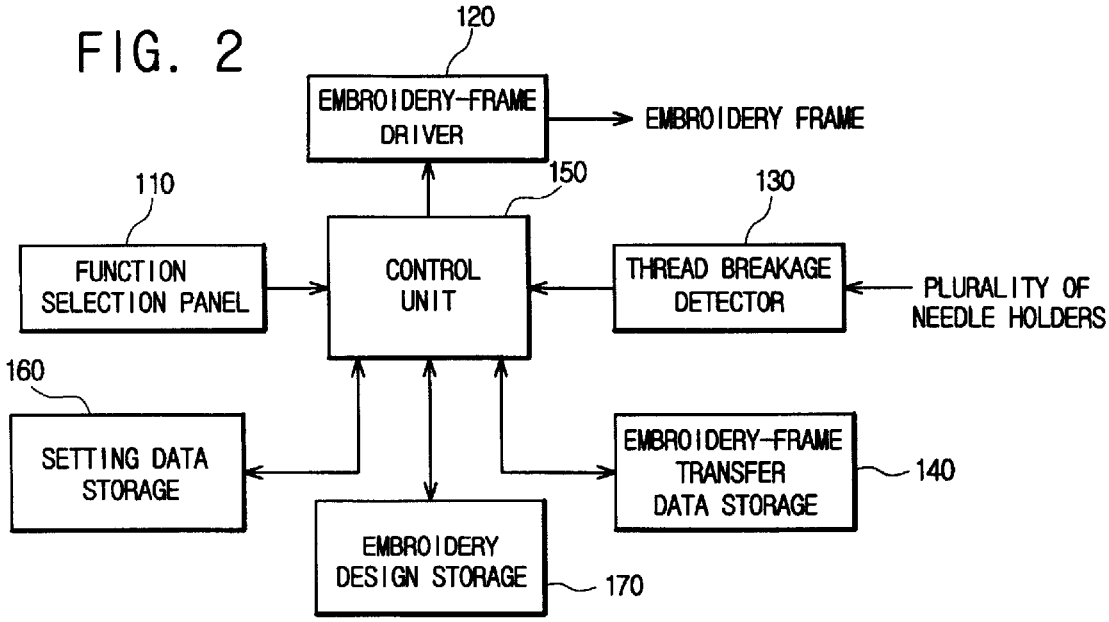
FIG. 2 is an exemplary block diagram illustrating an embroidery machine for transferring an embroidery frame backward in case of thread breakage in accordance with the present invention.

Referring to FIG. 2 is, there is shown an exemplary block diagram illustrating an embroidery machine for transferring an embroidery frame backward in case of thread breakage. The embroidery machine embroiders an embroidery design on a fabric fixed on an embroidery frame. The embroidery machine has the embroidery frame, the fabric fixed on the embroidery frame, needle holders having a plurality of needles. To perform an embroidery operation, the embroidery frame moves to X-axis and Y-axis directions and the needle holder moves up and down. A thread is threaded with a needle at the embroidery operation, wherein the thread includes an upper-positioned thread and an under-positioned thread. The embroidery machine includes a function selection panel 110, an embroidery-frame driver 120, a thread breakage detector 130, an embroidery-frame transfer data storage 140, and a control unit 150. The function selection panel 110 includes a plurality of keys for selecting a function. The embroidery-frame driver 120 drives the embroidery frame, contained in the embroidery machine, in response to a control signal outputted from the control unit 150. The thread breakage detector 130, located at a plurality of needle holders, detects the thread breakage. The embroidery-frame transfer data storage 140 stores an embroidery-frame transfer distance data even if the power of the embroidery machine is off. The control unit 150 generates the control signal so as to control the embroidery-frame driver 120. After the thread breakage detector 130 detects the thread breakage, the embroidery frame driver 120 transfers the embroidery frame backward in response to the control signal outputted from the control unit 150. At this time, the embroidery-frame driver 120 transfers the embroidery frame backward by an embroidery-frame transfer distance of the embroidery-frame transfer distance data.

Furthermore, the control unit 150 can be implemented as a microprocessor. A setting data storage 160 and an embroidery design storage 170 are coupled to the control unit 150, respectively. The setting data storage 160 and the embroidery design storage 170 can be located in the inside or outside of the control unit 150. The setting data storage 160 stores a plurality of setting data including an embroidery operation speed, a selected needle holder-related information, etc., wherein the plurality of setting data can be inputted by the user at the embroidery machine. The embroidery design storage 170 stores embroidery design information so that the user at the embroidery machine can select a desired embroidery design from the embroidery design information. Furthermore, the embroidery-frame transfer data storage 140 can be implemented as a flash memory, a nonvolatile random access memory (RAM) or a floppy disk. The embroidery-frame transfer distance data can be read from the embroidery-frame transfer data storage 140. Further, the embroidery-frame transfer distance data can be written to the embroidery-frame transfer data storage 140.

Figure 3:
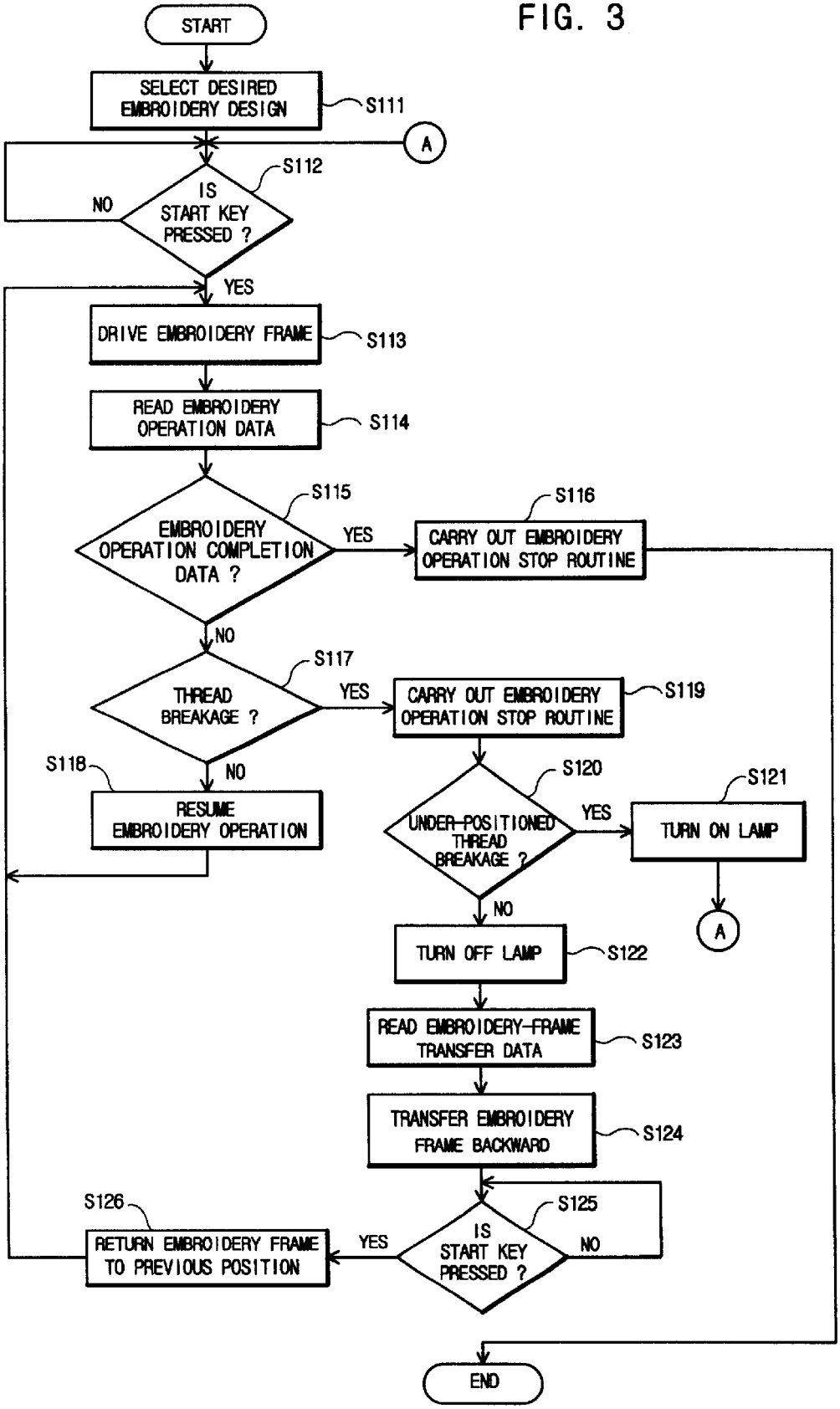
FIG. 3 is an exemplary flow chart illustrating a method for transferring an embroidery frame backward in case of thread breakage in accordance with the present invention.

Referring to FIG. 3, there is shown an exemplary flow chart describing a method for transferring the embroidery frame backward in case of the thread breakage. First, at step S111, the user at the embroidery machine selects a desired embroidery design stored in the embroidery design storage 170 through the function selection panel 110. At this time, the user sets the embroidery operation speed and the selected needle holder-related information. Then, at step S112, the control unit 150 determines whether the user presses a start key contained in the function selection panel 110 to start the embroidery operation. If the start key is pressed, at step S113, the embroidery-frame driver 120 drives the embroidery frame in response to a start key signal from the control unit 150.

Hereinafter, at step S114, the control unit 150 reads an embroidery operation data with respect to the desired embroidery design stored in the embroidery design storage 170. Then, at step S115, the control unit 150 determines whether the embroidery operation data represents an embroidery operation completion data. If the embroidery operation data represents the embroidery operation completion data, at step S116, the control unit 150 carries out an embroidery operation stop routine. Otherwise, if the embroidery operation data does not represent the embroidery operation completion data, at step S117, the control unit 150 determines whether there is a thread breakage signal from the thread breakage detector 130. Then, if there is not the thread breakage signal from the thread breakage detector 130, at step S118, the embroidery machine resumes the embroidery operation.

Otherwise, if there is the thread breakage signal from the thread breakage detector 130, at step S119, the control unit 150 carries out the embroidery operation stop routine. Then, at step S120, the control unit 150 determines whether the upper-positioned thread or the under-positioned thread is broken. If the upper-positioned thread is broken, at step S122, the lamp is turned off or the display displays an upper-positioned thread breakage indication. Then, at step S123, the control unit 150 reads the embroidery-frame transfer distance data from the embroidery-frame transfer data storage 140 so as to generate the control signal for controlling the embroidery-frame driver 120. Then, at step S124, the embroidery-frame driver 120 transfers the embroidery frame backward by an embroidery-frame transfer distance of the embroidery-frame transfer distance data in response to the control signal. Then, the user re-threads the needle of the upper-positioned thread. Then, at step S125, the control unit 150 determines whether the user presses the start key to re-start the embroidery operation. If the user presses the start key, at step S126, the embroidery-frame driver 120 returns the embroidery frame to a previous embroidery-frame position. In other words, the embroidery-frame driver 120 transfers the embroidery frame forward by the embroidery-frame transfer distance of the embroidery-frame transfer distance data.

Otherwise, if the under-positioned thread is broken, at step S121, the lamp is turned on or the display displays an under-positioned thread breakage indication. At this time, the user re-threads the needle of the under-positioned thread. Then, the embroidery operation is repeated from the steps S112.

Figure 4:
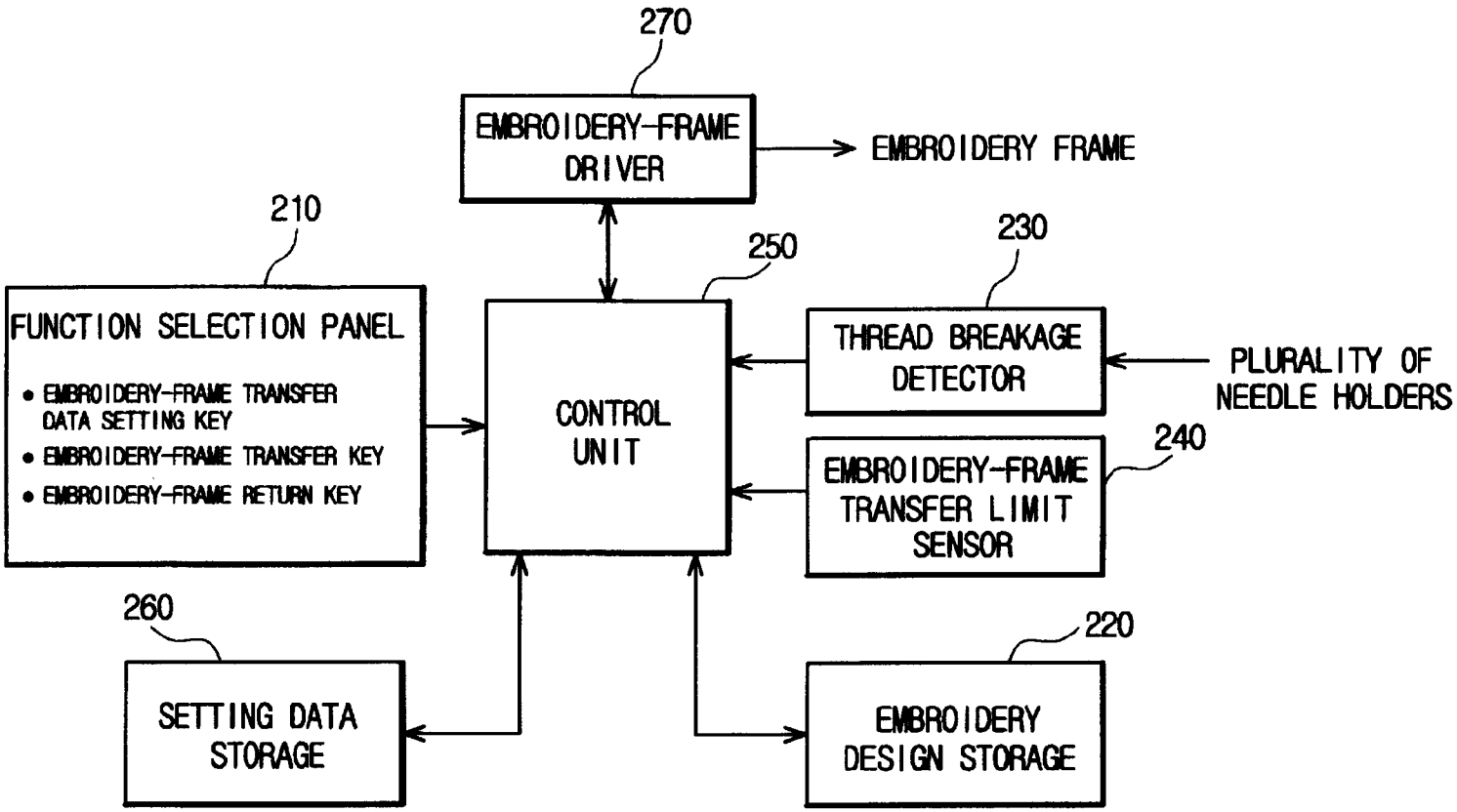
FIG. 4 is another exemplary block diagram illustrating an embroidery machine for transferring an embroidery frame backward in response to a user request in accordance with the present invention.

Referring to FIG. 4, there is shown another exemplary block diagram illustrating an embroidery machine for transferring the embroidery frame backward according to a user request. As shown, the embroidery machine includes a function selection unit 210, an embroidery design storage 220, a thread breakage detector 230, an embroidery-frame transfer limit sensor 240, a control unit 250, a setting data storage 260 and an embroidery-frame driver 270. Further, the embroidery machine further includes a display or a lamp. The display or the lamp indicates the thread breakage in response to a thread breakage signal outputted from the thread breakage detector 230. Accordingly, when the display or the lamp indicates the thread breakage, the user sends the user request through a plurality of keys so that the embroidery-frame driver 270 can transfer the embroidery frame forward or backward.

As compared to the embroidery machine shown in FIG. 2, the embroidery machine shown in FIG. 4 further includes the embroidery-frame transfer limit sensor 240. The embroidery-frame transfer limit sensor 240 senses a movement of the embroidery frame, e.g., the embroidery-frame transfer distance. The embroidery-frame transfer limit sensor 240 generates an embroidery-frame transfer stop signal if the embroidery frame reaches a predetermined limit position. The control unit 250 generates the control signal in response to the embroidery-frame transfer stop signal. The embroidery-frame driver 270 stops the embroidery-frame transfer in response to the control signal. The embroidery-frame transfer limit sensor 240 can be positioned on top, bottom, left and right side of the embroidery machine.

Further, the function selection panel 210 includes an embroidery-frame transfer data setting key, an embroidery-frame transfer key and an embroidery-frame return key. In order to transfer the embroidery frame backward when the thread is broken at the embroidery operation, the user can employ the embroidery-frame transfer data setting key, the embroidery-frame transfer key and the embroidery-frame return key.

The user can set the embroidery-frame transfer distance through the embroidery-frame transfer data setting key. Further, the setting data storage 260 stores an embroidery-frame transfer distance data, which is set through the embroidery-frame transfer data setting key. The user can transfer the embroidery frame backward by an embroidery-frame transfer distance of the embroidery-frame transfer distance data through the embroidery-frame transfer key. At this time, the function selection panel 210 generates the embroidery-frame transfer request signal. Then, the control unit 250 controls the embroidery-frame driver 270 in response to the embroidery-frame transfer request signal so that the embroidery-frame driver 270 can transfer the embroidery frame by the embroidery-frame transfer distance of the embroidery-frame transfer distance data.

The embroidery frame can be returned to a previous embroidery-frame position according to the user request through the embroidery-frame return key. At this time, the function selection panel 210 generates an embroidery-frame return request signal. Then, the control unit 250 controls the embroidery-frame driver 270 in response to the embroidery-frame return request signal so that the embroidery-frame driver 270 can return the embroidery frame to the previous embroidery-frame position. At this time, the embroidery-frame driver 270 transfers the embroidery frame forward by the embroidery-frame transfer distance of the embroidery-frame transfer distance data. As described above, the embroidery machine and method in accordance with the present invention can transfer the embroidery frame backward so that the user can easily re-thread the needle of the broken thread.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An embroidery machine for transferring an embroidery frame backward in case of thread breakage, the embroidery machine including the embroidery frame and needle holders holding needles, comprising:

detection means for detecting the thread breakage to generate a thread breakage signal if the thread breakage occurs at a needle contained in the needle holders;

transfer means for transferring the embroidery frame backward in response to a control signal;

control means, coupled to said detection means and said transfer means, for generating the control signal to control said transfer means in response to the thread breakage signal; and storage means, coupled to said control means, for storing embroidery-frame transfer distance data.

2. The embroidery machine as recited in claim 1, wherein said transfer means transfers the embroidery frame backward by an embroidery-frame transfer distance of the embroidery-frame transfer distance data stored in said storage means.

3. The embroidery machine as recited in claim 1, wherein the thread breakage includes upper thread breakage and under thread breakage and the control means determines whether an upper thread or an under thread is broken.

4. The embroidery machine as recited in claim 3, wherein said transfer means transfers the embroidery frame backward when the thread breakage is the upper thread breakage.

5. The embroidery machine as recited in claim 2, wherein said transfer means transfers the embroidery frame backward by the embroidery-frame transfer distance of the embroidery-frame transfer distance data when the thread breakage is upper thread breakage.

6. The embroidery machine as recited in claim 1, wherein said storage means includes a flash memory or a nonvolatile random access memory (RAM).

7. An embroidery machine for transferring an embroidery frame backward in case of thread breakage, the embroidery machine including the embroidery frame and needle holders holding needles, comprising:

generation means for generating an embroidery-frame transfer request signal in response to a user request if the thread breakage occurs at a needle contained in the needle holders;

transfer means for transferring the embroidery frame backward in response to a control signal; and control means, coupled to said transfer means and said generation means, for generating the control signal to control said transfer means in response to the embroidery-frame transfer request signal.

8. The embroidery machine as recited in claim 7, further comprising:

detection means for detecting the thread breakage; and indication means, coupled to said detection means, for indicating the thread breakage in response to the detected thread breakage.

9. The embroidery machine as recited in claim 7, further comprising:

sensing means, coupled to said control means, for sensing an embroidery-frame transfer distance and generating an embroidery-frame transfer stop signal if the embroidery frame reaches a predetermined limit position.

10. The embroidery machine as recited in claim 9, wherein said control means further generates another control signal in response to the embroidery-frame transfer stop signal and wherein said transfer means further stops an embroidery-frame transfer in response to another control signal.

11. The embroidery machine as recited in claim 7, further comprising:

second generation means for generating an embroidery-frame return signal in response to another user request.

12. The embroidery machine as recited in claim 11, wherein said control means further generates another control signal in response to the embroidery-frame return signal and wherein said transfer means further returns the embroidery-frame to a previous embroidery-frame position in response to another control signal.

13. The embroidery machine as recited in claim 7, further comprising:

storage means, coupled to said control means, for storing an embroidery-frame transfer distance data.

14. The embroidery machine as recited in claim 13, wherein said drive means transfers the embroidery frame backward by an embroidery-frame transfer distance of the embroidery-frame transfer distance data stored in said storage means.

15. The embroidery machine as recited in claim 13, wherein said storage means includes a flash memory or a nonvolatile random access memory (RAM).

16. A method for transferring an embroidery frame backward in case of thread breakage, comprising the steps of:

a) detecting the thread breakage to generate a thread breakage signal if the thread breakage occurs at a needle contained in needle holders;

b) generating a control signal to control an embroidery-frame driver in response to the thread breakage signal;

c) transferring the embroidery frame backward in response to the control signal; and d) storing embroidery-frame transfer distance data.

17. The method as recited in claim 16, wherein said step c) includes the step of transferring the embroidery frame backward by an embroidery-frame transfer distance of the embroidery-frame transfer distance data stored.

18. The method as recited in claim 16, wherein the thread breakage includes upper thread breakage and under thread breakage and step b) includes a step of determining whether an upper thread or an under thread is broken.

19. The method as recited in claim 18, wherein said step c) includes the step of transferring the embroidery frame backward when the thread breakage is the upper thread breakage.

20. A method for transferring an embroidery frame backward in case of thread breakage, comprising the steps of:

a) generating an embroidery-frame transfer request signal in response to a user request if the thread breakage occurs at a needle contained in needle holders;

b) generating a control signal to control an embroidery-frame driver in response to the embroidery-frame transfer request signal; and c) transferring the embroidery frame backward in response to the control signal.

21. The method as recited in claim 20, further comprising the steps of:

d) detecting the thread breakage; and e) indicating the thread breakage in response to the detected thread breakage.

22. The method as recited in claim 20, further comprising:

f) sensing an embroidery-frame transfer distance; and g) generating an embroidery-frame transfer stop signal if the embroidery frame reaches a predetermined limit position.

23. The method as recited in claim 22, wherein said step g) further includes the steps of:

g1) generating another control signal in response to the embroidery-frame transfer stop signal; and g2) stopping an embroidery-frame transfer in response to another control signal.

24. The method as recited in claim 20, further comprising the step of:

h) generating an embroidery-frame return signal in response to another user request.

25. The method as recited in claim 24, wherein said step h) further includes the steps of:

h1) generating another control signal in response to the embroidery-frame return signal; and h2) returning the embroidery-frame to a previous embroidery-frame position in response to another control signal.

26. The method as recited in claim 20, further comprising the step of:

i) storing an embroidery-frame transfer distance data.

27. The method as recited in claim 26, wherein said step c) includes the step of transferring the embroidery frame backward by an embroidery-frame transfer distance of the embroidery-frame transfer distance data stored.

* * * * *